United States Patent [19]

Kato et al.

[11] 4,215,288

[45] Jul. 29, 1980

[54] STORAGE TARGET FOR SCAN CONVERTER TUBES

[75] Inventors: Takefumi Kato, Hinode; Hajime Takita, Hino, both of Japan

[73] Assignee: Iwatsu Electric Co., Ltd., Tokyo, Japan

[21] Appl. No.: 890,495

[22] Filed: Mar. 27, 1978

[30] Foreign Application Priority Data

Apr. 14, 1977 [JP] Japan ..... 52-47591[U]

[51] Int. Cl.[2] ..... H01J 29/41

[52] U.S. Cl. ..... 313/394

[58] Field of Search ..... 313/391, 394, 392

[56] References Cited

U.S. PATENT DOCUMENTS

| | | | |
|---|---|---|---|
| 2,569,911 | 10/1951 | Ziebolz | 313/391 X |
| 2,708,726 | 5/1955 | Atherton | 313/394 X |
| 2,870,360 | 1/1959 | Knoll et al. | 313/394 X |
| 3,564,331 | 2/1971 | Moore | 313/394 X |
| 3,873,873 | 3/1975 | Marlowe | 313/392 |
| 4,119,992 | 10/1978 | Ipri et al. | 357/4 |

FOREIGN PATENT DOCUMENTS

| | | | |
|---|---|---|---|
| 2226748 | 11/1974 | France | 313/391 |

*Primary Examiner*—Robert Segal

*Attorney, Agent, or Firm*—Woodcock, Washburn, Kurtz, Mackiewicz & Norris

[57] ABSTRACT

A storage target having a collector electrode formed in a striped or latticed pattern on a storage substrate which is fabricated from a single crystal of electrically insulating material. Preferably, the storage substrate is of a single rhombohedral crystal of aluminum oxide or of a single isometric crystal of magnesium oxide, spinel, or calcium fluoride.

1 Claim, 16 Drawing Figures

STORAGE TARGET FOR SCAN CONVERTER TUBES

BACKGROUND OF THE INVENTION

1. Field of the Invention

This invention relates to storage tubes, to storage tubes of the variety known as scan converter tubes and, in particular, to a storage target of improved performance characteristics for use in scan converter tubes.

2. Description of the Prior Art

Oscilloscopes using cathode-ray tubes have been used extensively for the observation and analytical study of high-speed transient phenomena, high-speed signals of low repetition frequencies and the like, generally with unsatisfactory results. The advent of storage tubes with higher writing speed has long been awaited in various fields of electronics. In addition to the problem of low writing speed, the conventional storage tubes are disadvantageous in their low resistivity to electron beam bombardment and in their expensiveness.

Storage tubes can be broadly classified into direct-view and non-direct-view types. Included in the latter type is a scan converter tube which finds its principal application in the field of picture processing, being used as a frame memory or the like. In its use as a frame memory, the writing speed of the scan converter tube is required to be only just as high as that required for conversion of an optical image into an electrical signal by a television camera tube. The writing speed of the conventional scan converter tube is insufficient, however, for high-resolution operation wherein the number of scanning lines is doubled. The conventional scan converter tube has the additional problem of so-called "burning" caused by the electron beam and or impairment by soft X-rays generated by the interaction of the electron beam and the field mesh.

The storage target in the scan converter tube comprises, according to a typical prior art example, a silicon substrate, a silicon dioxide storage layer formed on the substrate by thermal oxidation thereof, and a collector electrode of latticed or striped design formed further on the storage layer. The collector electrode functions as such during writing and erasing operations and as a reading electrode during reading operation. The latticed or striped collector electrode is therefore electrically connected to a collector voltage supply circuit and to a reading circuit.

While the storage layer of the prior art storage target is usually formed as aforesaid by thermal oxidation of the silicon substrate, this layer may also be created by other methods such as cathode sputtering or chemical vapor deposition of silicon dioxide or other insulating substance on the silicon substrate. Regardless of the way the storage layer is formed, the crystal lattice constant and thermal expansion coefficient of the silicon substrate differ from those of the storage layer thereon. The storage layer is therefore either noncrystalline or polycrystalline. As a consequence, the thickness of the storage layer has been limited to 2 to 3 microns by reasons of possible cracking and buckling. Because of such small thickness of the storage layer, the capacity of the storage target increases, with the consequent decrease in writing speed.

The non- or polycrystalline storage layer of the prior art storage target also provides a cause for a low secondary emission ratio (number of secondary electrons/number of primary electrons) and, therefore, for low writing speed. The secondary emission ratio is further lowered by the impurity and surface contamination of the storge layer, as such contamination occurs, during the formation of the collector electrode thereon, by surface adsorption of impurities because of its non- or polycrystalline nature. The molecular binding of the storage layer is also low, so that the layer is susceptible to burning upon electron beam bombardment. Furthermore, as a number of levels exist in the energy gap of the storage layer, leakage and impairment by soft X-rays also present problems, setting limits upon zooming operation.

According to another example of storage target heretofore used in a scan converter tube, a collector electrode is formed on a glass substrate. The secondary emission ratio of this second prior art storage target is also very low because its glass substrate is noncrystalline, containing much impurities. As in the preceding example, the secondary emission ratio is further lowered during the formation of the collector electrode on the substrate. The silicon dioxide storage layer is highly susceptible to contamination by alkaline ions, particularly sodium ions, giving rise to problems such as unstable operation, shorter storage time, and variation in the level of scanned areas. It may be stated by way of reference that the secondary emission ratio of the cleavage face of high purity quartz glass in vacuum is approximately 2. Probably, the secondary emission ratio of the above prior art examples is considerably less than 2.

It is possible to lessen the electrostatic capacity of the storage target by increasing the thickness of its glass substrate. As will be later explained in further detail, however, the above statement must be taken in light of the fact that, as the substrate thickness is increased to a certain degree, the electrostatic capacity of the storage target is determined rather by the pitch of the collector stripes or the like and by other factors. Sufficiently high writing speed cannot therefore be attained by this measure. The prior art storage target with the glass substrate, moreover, has the same problem of easy impairment by an electron beam and soft X-rays as that encountered with the first described prior art storage target with the silicon dioxide storage layer.

An equivalent of the storage target in a storage tube of the direct-view type is a storage mesh, which includes a fine metal mesh having formed thereon a storage layer of, typically, magnesium oxide. The magnesium oxide storage layer is formed either by baking magnesium oxide powder or by evaporation of magnesium in an oxidative atmosphere.

Typically, the direct-view storage tube with such a storage mesh has a writing speed of, in terms of frequency, up to about 10 megahertz (100 cm/$\mu$s). This limitation is imposed by the low secondary emission ratio of the magnesium oxide storage layer, which is either non- or polycrystalline like the above described prior art storage layers of scan converter tubes.

During writing operation, the cathode of the direct-view storage tube is set at $-1800$ volts, and the storage mesh at or close to ground potential, so that the acceleration energy of the writing beam is about 1800 electron volts. Generally speaking, the writing beam energy should be so determined as to realize substantially the maximum possible secondary emission ratio.

In the direct-view storage tube of the type under consideration, however, it is necessary to give a certain degree of beam acceleration energy in order to prevent an undesired increase in the spot diameter of the electron beam. The acceleration voltage setting actually employed, therefore, is not the one which will provide the maximum possible secondary emission ratio, so that the writing speed is limited also in this respect. The low writing speed of the direct-view storage tube is further attributable to the poor practical efficiency of the writing beam because of the presence of the storage mesh and a collector mesh in the tube.

Another serious problem that must be taken into consideration in connection with the prior art direct-view storage tube is the thermal impairment of the storage mesh by the electron beam. This is due to the poor binding of the constituent molecules of the non- or polycrystalline storage layer. Moreover, since this storage layer lies on the metal mesh, these components of the storage mesh have a great difference in their thermal expansion coefficient, so that high localized heating takes place by Joule heat upon electron beam bombardment.

A technique known as the "high speed mode" has been employed in connection with the direct-view storage tube of this type, for improving the writing speed through an increase in beam acceleration energy during writing operation. The writing speed can certainly be multiplied by this technique. The problem of burning by the electron beam becomes all the more serious, however, because of the increased beam acceleration energy and increased beam intensity. Furthermore, the acceleration energy is set at a value considerably off the value which will give the maximum secondary emission ratio. The writing speed does not increase so much as the increase in electron beam intensity. The doubling of the beam acceleration energy results in approximately the halving of the deflection zone, to the inconvenience of the viewer. This is due to a decrease in deflection sensitivity caused by the increased beam velocity.

The prior art direct-view storage tube has the additional disadvantage of being expensive, because of difficulties involved in the manufacture of its storage mesh and collector mesh. This has also been an impediment to the widespread use of the storage tube. Thus, the prior art storage tubes of direct- and non-direct-view types alike have the problems of limited writing speed, the burning of the storage media by electron beams, and so forth, all accruing from the noted imperfections of the storage media.

SUMMARY OF THE INVENTION

It is an object of this invention to provide an improved storage target, for particular use in a scan converter tube, that is capable of increasing writing speed, of withstanding the adverse effects of electron beam bombardment, and of increasing reading time.

This and other objects are accomplished, in accordance with the invention, by the provision of a storage target having a storage layer or substrate fabricated from a single crystal of an insulator which is either insoluble or only slightly soluble in water, and a collector electrode which overlies one of the faces of the storage layer and which is in the form of a metal film having a plurality of openings formed therein in a more or less regular pattern.

The monocrystalline insulators for use as the substrate of the storage target according to the invention should be of the highest possible purity and have little or no lattice defect. Preferably, the substrate material is selected from among the artificial single crystals of aluminum oxide (e.g., colorless sapphire), magnesium oxide, a mixture (spinel) of aluminum oxide and magnesium oxide, and calcium fluoride. All these insulator crystals are insoluble or hardly soluble in water. In the use of the single crystal of aluminum oxide, which is of rhombohedral system, the C axis (i.e., light axis) of the crystal can be oriented either normal or parallel to the collector-carrying face of the substrate.

The above and other objects, features and advantages of this invention and the manner of attaining them will become more readily apparent, and the invention itself will best be understood, from the following description of some preferred embodiments taken in conjunction with the accompanying drawings.

DESCRIPTION OF THE PREFERRED EMBODIMENTS

Figure 1:
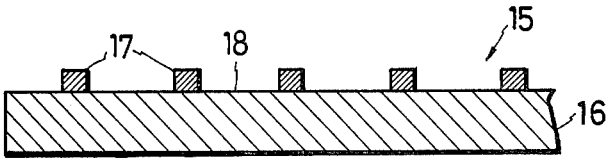
FIG. 1 is a partial sectional view of an example of the storage target according to this invention.

Referring now to the above drawings in detail and initially to FIG. 1 thereof, the reference numeral 15 generally designates the improved storage target of this invention. The storage target 15 comprises a storage layer or substrate 16 of generally sheetlike form and a collector electrode 17 formed on a face 18 of the storage substrate.

The storage substrate 16 of the target 15 is in the form of a monocrystalline sheet of electrically insulating material with a thickness of approximately 0.3 millimeter. Preferably, the storage substrate 16 is fabricated from either of the single crystals of aluminum oxide ($Al_2O_3$), magnesium oxide ($M_gO$), a mixture (spinel) of aluminum oxide and magnesium oxide, and calcium fluoride ($CaF_2$). Of these, the single crystal of aluminum oxide is of rhombohedral system, whereas the single crystals of magnesium oxide, spinel, and calcium fluoride are all of isometric system. All these monocrystalline insulators should be of the highest possible purity and have little or no lattice defect. The use of man-made crystals is therefore recommended.

Figure 3:
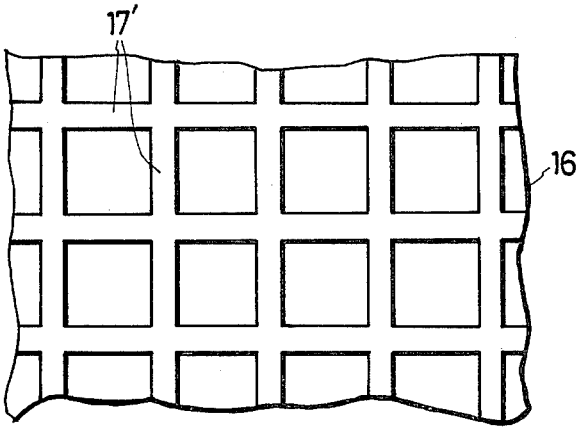
FIG. 3 is also a partial plan view explanatory of another example of the collector electrode pattern.
Figure 4:
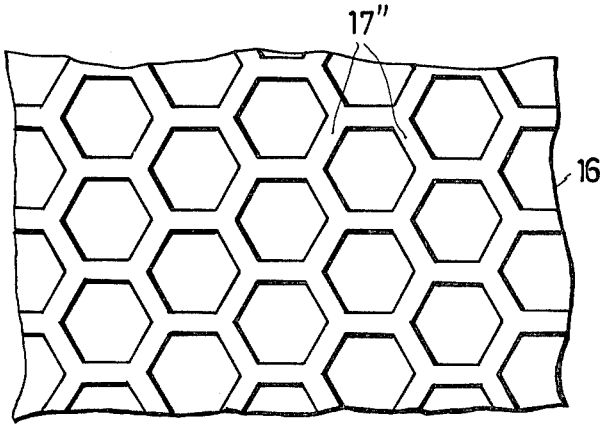
FIG. 4 is also a partial plan view explanatory of still another example of the collector electrode pattern.

The collector electrode 17 on the storage substrate 16 is in the form of an extremely thin, metal sheet or film having a plurality or multiplicity of openings formed therein in a prescribed regular pattern. In practice, the collector electrode 17 can be either in the shape of parallel stripes, as shown at 17 in FIG. 2, or of a lattice as shown in 17' in FIG. 3. Alternatively, as illustrated in FIG. 4, the metal film of the collector electrode (therein designated 17'') may have a number of hexagonal openings formed therein in the most closely packed or staggered arrangement. As mentioned in connection with the prior art, the collector electrode of the storage target is intended for electrical connection to a collector voltage supply circuit and to a reading circuit, which are both not shown.

Figure 5:
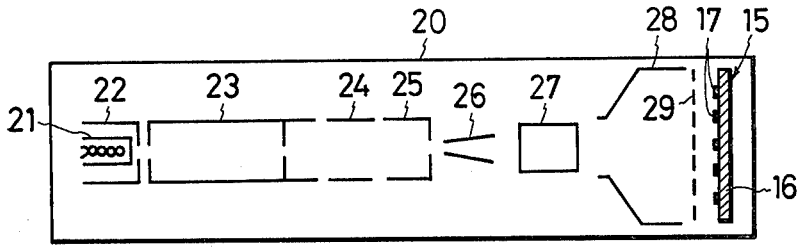
FIG. 5 is a schematic sectional view of a scan converter tube incorporating the storage target of the invention.

Schematically represented in FIG. 5 is an example of scan converter tube in which there is incorporated the storage target of this invention. Of the electrostatic deflection, electrostatic focusing type, the exemplified scan converter tube comprises an envelope 20 serving as the vacuum enclosure, cathode 21 control grid 22, accelerating grid 23, focusing electrode 24, astigmatism electrode 25, Y deflector plates 26, X deflector plates 27, collimation electrode 28, field mesh 29, and the storage target 15 of this invention which is composed as aforesaid of the substrate 16 and the collector electrode 17.

The various electrodes of the above scan converter tube are connected to the usual associated electric circuits in the well known manner. The scan converter tube of this general configuration provides the three basic operations of writing, reading, and erasing. During each of these operations, a required voltage is applied to the collector electrode 17 of the storage target 15, and a signal for reading is obtained by utilizing the collector electrode. Erasure is effected by uniform bombardment of the storage target 15 with the electron beam from the cathode.

Figure 6:
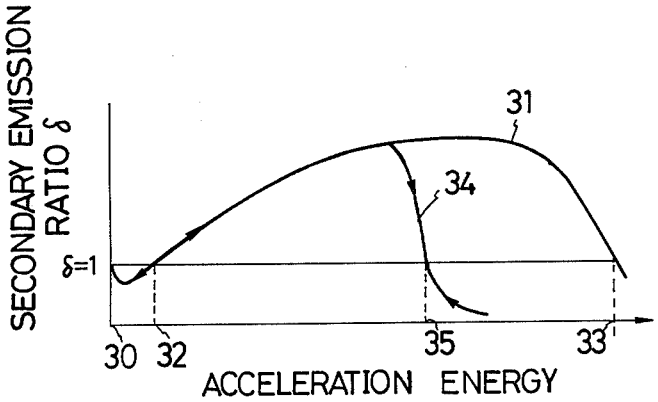
FIG. 6 is a graphic representation of the relationship between the secondary emission ratio of the storage substrate according to the invention and electron beam acceleration energy.

FIG. 6 is a graphic representation of the relationship between the ratio $\delta$ of secondary electron emission upon electron beam bombardment of the storage target and the acceleration energy of the electron beam, and of the action of the secondary electrons. In the graph, cathode potential designated 30 is used as the reference (assumed to be zero), and the secondary emission ratio curve characteristic of the storage substrate 16 is given at 31.

It will be seen from the graph of FIG. 6 that the curve 31 crosses the line where the secondary emission ratio $\delta$ is unity at the cathode potential 30, a first crossing potential 32 (about 30 electron volts with the monocrystalline substances of this invention), and at a second crossing potential 33. The secondary emission ratio is less than unity between the cathode potential 30 and the first crossing potential 32 and above the second crossing potential 33, and is more than unity between the first and the second crossing potentials. The arrowheads on the curve 31 represent the directions of change in the potential of the face 18 of the storage substrate 16, meaning that the surface potential rises when the ratio $\delta$ is more than unity and that the surface potential drops when the ratio is less than unity.

The reference numeral 34 in the graph of FIG. 6 represents the secondary emission ratio curve in case the electrode 17 of the storage target is maintained at a potential 35 between the first 32 and the second 33 crossing potentials. The deviation from the curve 31 is explained as follows. The secondary electrons emitted from the storage substrate face 18 are captured by an adjacent part of the highest potential (i.e., the collector electrode 17). As the surface potential of the storage substrate 16 exceeds the collector electrode potential 35, however, the secondary electrons have nowhere to go and therefore return to the substrate face.

The potential of the collector electrode 17 may be set at a value at which the ratio $\delta$ is less than unity, for example, at 15 volts with respect to the cathode. By then uniformly bombarding the storage target with the electron beam, the substrate face 18 acquires the cathode potential 30, in accordance with the indication of the arrowhead in FIG. 6. Erasure of the information can thus be effected.

For writing, the potential of the collector electrode 17 of the storage target may be set at, for example, 1 kilovolt (less than the second crossing potential), with the result that the substrate face 18 has a potential of, for example, 985 volts. Desired information can be written as a signal is then applied to the control grid 22 of the scan converter tube for modulation of the electron beam intensity and as signals are also applied to the Y and X deflector plates 26 and 27. In the written areas, the potential rises in accordance with the indication of the arrowhead on the curve 34 of FIG. 6 and approaches the collector potential of 1 kilovolt.

For reading, the collector electrode 17 is set at a low potential of, for example, 10 volts. In the written areas of positive potential, the electron beam reaches the collector electrode 17 in accordance with the written amount. In the unwritten areas of negative potential, however, the electron beam is prevented from reaching the collector electrode by the coplanar grid effect. This difference can be utilized by the collector electrode 17 for reading the information. The collector electrode 17 may therefore be also termed a reading electrode.

The foregoing description is directed to the functions of the storage target of this invention as incorporated in the scan converter tube of the electrostatic deflection, electrostatic focusing type. It will of course be understood that the storage target of the invention can be incorporated in the scan converter tube of the electromagnetic deflection, electromagnetic focusing type as well.

Returning to the construction of the storage target 15, the monocrystalline insulators to be employed for the manufacture of the storage substrate 16 of the target are required to have a highly insulative effect (preferably at least $10^{14}$ $\Omega$/cm) and a high secondary emission ratio $\delta$ in order to overcome, as far as possible, the conventional limitations on storage and reading times.

The writing speed of the scan converter tube in general can be defined as:

$$Ws = K\frac{(\delta - 1)}{C} \quad (1)$$

where Ws is the writing speed, K is the constant associated with writing beam intensity, and C is the electrostatic capacity per unit area of the storage target.

It will be apparent from formula (1) that the writing speed of the scan converter tube is proportional to ($\delta-1$). In order to determine the difference in ($\delta-1$) between the target with the monocrystalline insulator substrate according to the invention and that with the noncrystalline silicon dioxide substrate in accordance with the prior art, the maximum ($\delta-1$) value of the target with the monocrystalline aluminum oxide substrate, with the electron beam acceleration energy between 1.5 and 3 kilo electron volts, was compared with the maximum ($\delta-1$) value of the prior art target with the noncrystalline silicon dioxide substrate, with the electron beam acceleration energy between 200 and 400 electron volts. The maximum ($\delta-1$) value of the target with the monocrystalline aluminum oxide substrate, having the C axis (optical axis) oriented normal to the substrate face, was 17 times as much as that of the prior art target with the noncrystalline silicon dioxide substrate.

The maximum ($\delta-1$) value of the target with the monocrystalline aluminum oxide substrate, having the C axis oriented parallel to the substrate face, was 5.2 times as much as that of the prior art target with the noncrystalline silicon dioxide substrate. The maximum ($\delta-1$) value of the target with the monocrystalline magnesium oxide substrate was 4.3 times as much as that of the prior art target. The maximum ($\delta-1$) value of the target with the monocrystalline spinel substrate was 4.8 times as much as that of the prior art target. The maximum ($\delta-1$) value of the target with the monocrystalline calcium fluoride substrate was 3.4 times as much as that of the prior art.

It will be noted from the foregoing results that the secondary emission ratio of the target with the monocrystalline aluminum oxide substrate is dependent upon crystal orientation. The ratio is equally high, however, either in case the C axis is oriented normal to or parallel to the substrate face. The secondary emission ratio of the targets with their substrates fabricated from the other monocrystalline insulators according to the invention is independent of crystal orientation.

Figure 7:
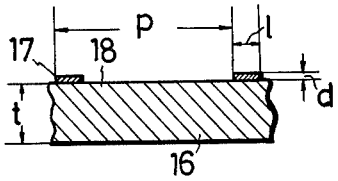
FIG. 7 is a view explanatory of the geometrical dimensions of the storage target according to the invention.
Figure 8:
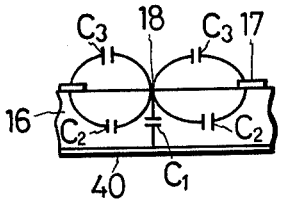
FIG. 8 is a view similar to FIG. 7 but explanatory of the capacity components of the storage target according to the invention.

The writing speed Ws of the scan converter tube is also dependent upon the electrostatic capacity of the storage target in use. With reference to FIG. 7, which shows the storage target of this invention, let t be the thickness of the storage substrate 16; p the pitch of the stripes forming the collector electrode 17; d the thickness of each collector stripe (approximately 0.1 micron); and l the width of each collector stripe. Further, with reference to FIG. 8, let it be assumed that the electrostatic capacity C of the storage target is comprised of a parallel junction of the capacity C1 in the thickness direction of the substrate 16 (the presence of a backward electrode 40 assumed to facilitate explanation), and the capacity C2 between the collector stripes 17 through the substrate and the capacity C3 between the collector stripes through the substrate face 18 and vacuum. These capacities depend upon the geometrical dimensions t, p, d and l of the storage target and upon the specific dielectric constant $\epsilon_s$ of the particular material of which the storage substrate is made.

Figure 2:
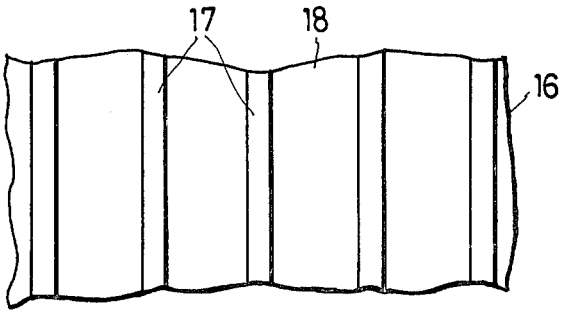
FIG. 2 is a partial plan view explanatory of an example of the pattern of the collector electrode on the substrate of the storage target according to the invention.

Disregarding the thickness of the collector electrode 17, and assuming the collector electrode to be in the form of parallel stripes as shown in FIG. 2, the capacities per square centimeter can be given as:

$$C_1=(1/\pi)\epsilon_o\,\epsilon_s\,(1-f)\cos^{-1}\sin^2(\pi f/2)/t \qquad (2)$$

$$C_2+C_3=\frac{2\epsilon_o(1+\epsilon_s)}{\pi p}\left[\ln\frac{\cos\frac{\pi}{2}\left[\frac{1}{\pi}\cos^{-1}(\sin^2\frac{\pi f}{2}-f)\right]}{\cos\frac{\pi}{2}\left[f+\frac{1}{\pi}\cos^{-1}(\sin^2\frac{\pi f}{2})\right]}\right] \qquad (3)$$

where $\epsilon_o$ is the dielectric constant of vacuum, and f is the "electrode density" 1/p. $C_2+C_3$ represents the substantial capacity.

Figure 9:
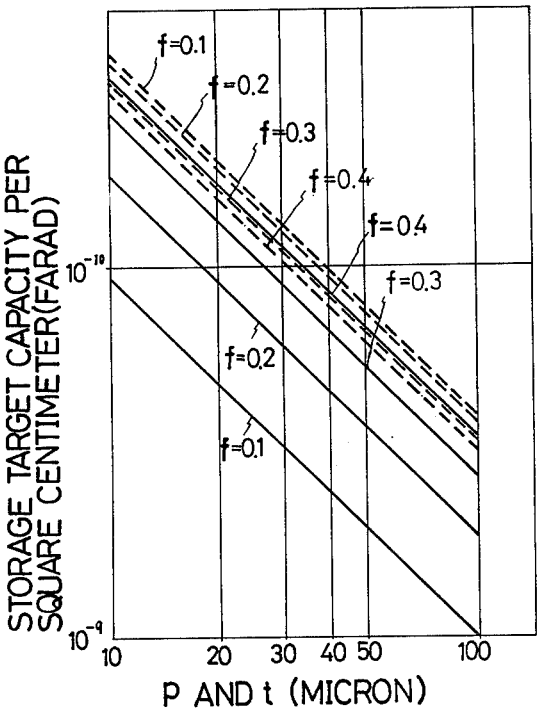
FIG. 9 is a graphic representation of the capacity of the storage target according to the invention per unit area.

FIG. 9 graphically represents the capacities $C_1$ and $C_2+C_3$, with the "electrode density" f taken as a parameter. The vertical axis of the graph represents the capacities, in farads, and the horizontal axis represents the substrate thickness t for the capacity $C_1$ and the collector stripe pitch p for the capacity $C_2+C_3$, in microns. The capacity $C_1$ is given by the dotted lines, and the capacity $C_2+C_3$ by the solid lines. The specific dielectric constant $\epsilon_s$ is 9.8 because the storage substrate 16 is now assumed to be of monocrystalline magnesium oxide.

It is seen from the graph of FIG. 9 that, roughly speaking, the capacity $C_1$ equals the capacity $C_2+C_3$ as the substrate thickness t becomes twice as much as the collector stripe pitch p. As the substrate thickness becomes greater than twice the collector stripe pitch, the capacity $C_1$ becomes less than the capacity $C_2+C_3$. Therefore, in order to make the capacity $C_1$ sufficiently low, it is neccesary to make the substrate thickness t at least five times as much as the collector stripe pitch p.

From the foregoing considerations, it is clear that the storage target capacity is greatly affected not only by the substrate thickness t but also by the collector stripe pitch p and the "electrode density" f. An increase in the collector stripe pitch p leads to a decrease in the capacity $C_2+C_3$, but also to a decrease in the degree of resolution. In practice, the pitch p can be in the range of from about 10 to 50 microns. The "electrode density" f may be reduced to make the capacity smaller, but 0.1 is believed to be the minimum limit imposed by practical reasons in manufacture. The "electrode density" f can be in the range of from about 0.1 to 0.4 in practice.

The storage target capacity depends upon the specific dielectric constant $\epsilon_s$, aside from its geometrical dimensions. As far as that region of the storage target is concerned over which the capacity $C_2+C_3$ in the direction parallel to the substrate plane predominates, the storage target capacity is proportional to $(1+\epsilon_s)$ according to formula (3). Therefore, formula (1) can be rewritten as:

$$Ws = K'\frac{(\delta-1)}{(1+\epsilon_s)} \qquad (4)$$

where K' is a constant.

The specific dielectric constant $\epsilon_s$ of noncrystalline silicon dioxide is 4. The specific dielectric constant of monocrystalline aluminum oxide, which is dependent upon crystal orientation, is about 10.5 in case the C axis is oriented normal to the substrate face and about 8.6 in case the C axis is oriented parallel to the substrate face. The specific dielectric constant of monocrystalline magnesium oxide is about 9.8, and that of monocrystalline calcium fluoride is about 6.7. In the use of monocrystalline aluminum oxide as the storage substrate of the target according to the invention, its C axis should preferably be oriented normal to the substrate face for reduction of the capacity.

The writing speed of the storage target with its substrate made of various materials can be computed in accordance with formula (4), by using the foregoing specific dielectric constant values and the above mentioned maximum values of $(\delta-1)$. The writing speed of the storage target with the monocrystalline aluminum oxide substrate, with the C axis oriented normal to the substrate face, is 10 times as high as that of the prior art storage target with the silicon dioxide substrate. The writing speed of the monocrystalline aluminum oxide storage target, with the C axis oriented parallel to the substrate face, is twice as high as that of the prior art silicon dioxide storage target. The writing speed of the monocrystalline magnesium oxide storage target is twice as high as that of the prior art silicon dioxide storage target. The writing speed of the monocrystalline spinel storage target is twice as high as that of the prior art silicon dioxide storage target. The writing speed of the monocrystalline calcium fluoride storage target is 2.2 times as high as that of the prior art silicon dioxide storage target.

The writing speed of the conventional scan converter tube using the glass substrate in its storage target is ordinarily up to several megahertz. With the use of the monocrystalline aluminum oxide storage target according to the invention, with the C axis oriented normal to the substrate face, the writing speed becomes as high as 200 megahertz (2000 cm/μs) or more. The writing speed of the monocrystalline aluminum oxide storage target, with the C axis oriented parallel to the substrate face, is at least 50 megahertz (500 cm/μs). The writing speed of the monocrystalline magnesium oxide storage target, the monocrystalline spinel storage target, and the monocrystalline calcium fluoride storage target is all at least 50 megahertz (500 cm/μs). The writing speed of the scan converter tube can thus be markedly increased by use of the storage target of this invention.

The reading time of the monocrystalline aluminum oxide, magnesium oxide, and spinel storage targets according to the invention is approximately twice as much as that of the noncrystalline silicon dioxide storage target according to the prior art. The reading time of the monocrystalline alcium fluoride storage target according to the invention is approximately 1.5 times as much as that of the prior art silicon dioxide storage target.

One of the limitations heretofore imposed upon reading time has been the fact that positive ions generated as a result of the collision of the reading beam with the residual gas within the tube attach to the face of the storage target substrate, with the consequent rise in potential. Another limitation has been the undesired erasure of written information by the action of electrons excited by soft X-rays generated upon reading beam bombardment of the field mesh.

Thanks to the storage target of this invention, reading time can be significantly improved as above. This is supposedly due to the fact that the target is little affected by electrons or ions generated by the reading beam, because of its higher dielectric constant and greater electrostatic capacity. Moreover, owing to the use of the monocrystalline insulator substrate, few levels exist in the energy gap, resulting in the excitation of little electrons by soft X-rays.

Figure 10:
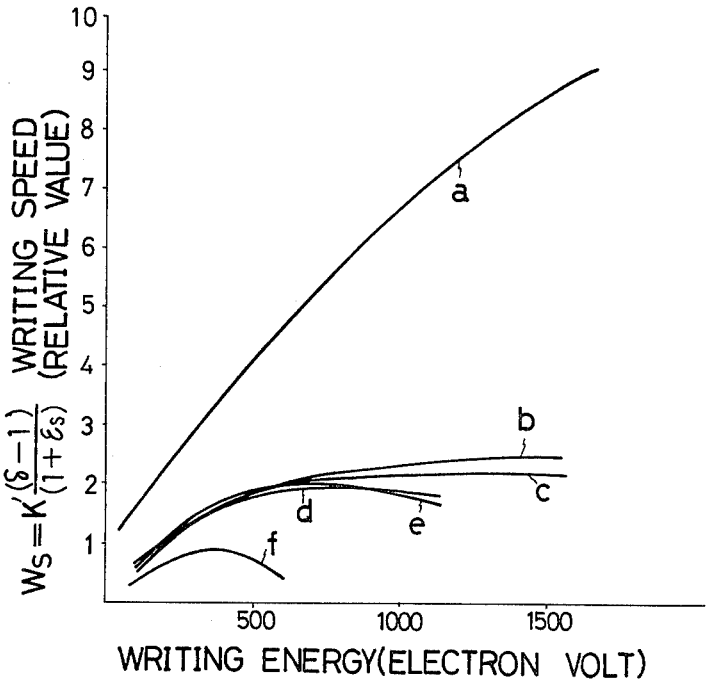
FIG. 10 is a graph plotting the curves of the writing speed, against writing energy, of storage targets having their substrates fabricated from various materials according to the invention and to the prior art.

FIG. 10 is a graphic representation of the curves of the writing speed Ws, as defined by formula (4), of various storage targets, in relative values, against writing energy in electron volts. The curve a represents the writing speed characteristic of the monocrystalline aluminum oxide storage target with the C axis oriented normal to the substrate face. The curve b represents the writing speed characteristic of the monocrystalline aluminum oxide storage target with the C axis oriented parallel to the substrate face. The curve c is the writing speed characteristic of the monocrystalline spinel storage target; the curve d that of the monocrystalline magnesium oxide storage target; and the curve e that of the monocrystalline calcium fluoride storage target. By way of comparison, the curve f represents the writing speed characteristics of the prior art noncrystalline silicon dioxide storage target.

The materials employed for the manufacture of the storage substrate according to the invention should have a purity of 99.9% or more. This is because the secondary emission ratio deteriorates with an increase in the impurity concentration of the storage substrate, resulting in lower writing speed and greater burning upon electron beam bombardment. One of the causes for such burning of the storage substrate can be explained as follows is connection with the purity of the substrate material. The density of defects in the crystal increases with increasing impurity concentration, so that many traps produced in its energy gap capture mobile electrons upon electron beam bombardment of the target. This affects the potential on the crystal surface, giving rise to the phenomenon of burning.

The freedom from burning of the storage substrate according to the invention can also be attributed to the monocrystallinity of the substrate material in use, in addition to its high purity. Obviously, the "crystal energy" of the monocrystalline substrate material is something more than the mere energy of molecular binding. The storage substrate according to the invention is therefore little affected by electron beam bombardment, eliminating the problem of burning which has been encountered with the conventional noncrystalline silicon dioxide substrate.

Computed by Born's method, with the use of Madelung constant and Pauling's inter-ion distance, the crystal energy of the single crystals of aluminum oxide, calcium fluoride, and magnesium oxide is as high as 15,018, 2495 and 945 kcal/mol, respectively. The melting point of the single crystals of aluminum oxide, spinel, calcium fluoride, and magnesium oxide is also as high as 2030°, 2050°, 1402° and 2800° C., respectively. It will of course be understood that the single crystals are to suffer hardly any impairment from soft X-rays. According to the experiments made by the present inventors, the conventional glass substrate burned in a few minutes, and the conventional high-purity, non-crystalline silicon dioxide substrate burned in about 5 minutes. The monocrystalline aluminum oxide substrate according to the invention, however, did not burn when tested for 24 hours under the same conditions as the prior art substrates.

The storage target according to this invention has the additional advantage of suffering little or no contamination during manufacture, thus helping to realize high picture quality. Since the collector electrode 17 of the storage target is formed by photoetching or similar techniques, the materials for its substrate 16 are required to be chemically stable and to be insoluble or hardly soluble in water. In view of the delicate manufacturing technique to be employed for the formation of the collector electrode, the substrate face should be mirror finished. The substrate materials are therefore further required to have sufficient mechanical strength to develop no cracks during grinding into such mirror-like finish.

All the above listed requirements are met by the substrate materials of monocrystalline aluminum oxide, magnesium oxide, spinel, and calcium fluoride according to the invention. All these materials can be easily processed into the storage substrate, without causing fluctuating picture quality or deterioration of the secondary emission ratio through surface contamination. Noncrystalline films formed by cathode sputtering, chemical vapor deposition, or evaporation of aluminum oxide, magnesium oxdie or calcium fluoride, for example, would have a low secondary emission ratio because of their noncrystallinity. Their emission ratio and picture quality would further deteriorate through surface contamination. Similar problems are encountered with the conventional noncrystalline silicon dioxide storage substrate.

Figure 11:
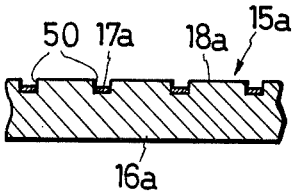
FIG. 11 is a partial sectional view of a modification of the storage target according to the invention.

Shown in FIG. 11 is a slight modification of the storage target 15 of FIG. 1. The modified storage target, generally designated 15*a*, comprises a substrate 16*a* which can be fabricated from the same materials as the substrate 16 of the target 15. This substrate 16*a* differs from the preceding example in that a suitably patterned depression 50 is etched or otherwise formed in its face 18*a* for receiving a collector electrode 17*a*, which can be similar in pattern to the electrodes shown in FIGS. 2, 3 and 4. The target configuration of FIG. 11 results in an improved modulation characteristic and in higher apparent writing speed.

Figure 12A:
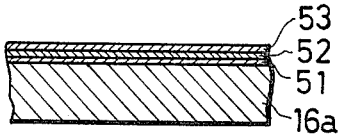
FIGS. 12A through 12E are a series of partial sectional views explanatory of the sequential steps of manufacture of the modified storage target.

FIGS. 12A through 12E are explanatory of a method of fabricating a storage target essentially identical in configuration with that shown in FIG. 11. With reference first to FIG. 12A, a layer 51 of chromium is first formed on the monocrystalline aluminum oxide substrate 16*a* to a thickness of 0.1 micron by evaporation, and another layer 52 of aluminum is formed on the chromium layer to a thickness of 0.5 micron by evaporation. Still another layer 53 of a photoresist is coated on the aluminum layer 52 to a thicknss of 0.4 micron, as by means of a spinner.

Figure 12B:
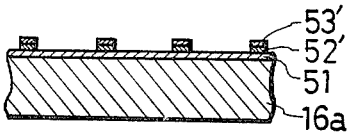
Figure 12C:
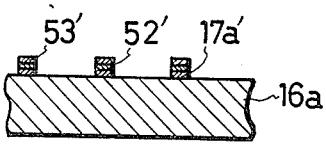

After masking, the photoresist layer 53 is selectively exposed and developed to form a resist pattern 53', FIG. 12B, that corresponds to the mask pattern. After postbaking, the aluminum layer 52 is selectively etched to form an aluminum pattern 52' corresponding to the mask pattern. The chromium layer 51 is then selectively etched to form the collector electrode 17*a'* of the desired pattern, as shown in FIG. 12C. In case a chemical etching process is employed, the etchant in use should be one which will not attack the aluminum pattern 52'. Ceric ammonium nitrate is an example of such an etchant. In the case of a dry process such as plasma etching or ion etching, the resist pattern 53' would be destroyed unless the aluminum layer 52 is of sufficient thickness.

Figure 12D:
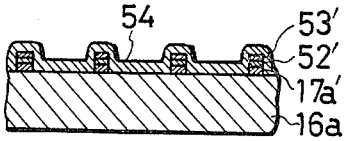

With reference to FIG. 12D, a layer 54 of aluminum oxide with a purity of 99.9% or more is then formed by sputtering over the entire exposed surfaces of the monocrystalline aluminum oxide substrate 16*a* and the chromium collector pattern 17*a'* and aluminum 52' and resist 53' patterns on the substrate. The thickness of this aluminum oxide layer 54 should be approximately one half or less of the total thickness of the chromium 17*a'*, aluminum 52' and resist 53' layers on the substrate 16*a*.

Figure 12E:
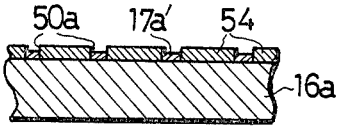

The patterned aluminum layers 52' together with the other unnecessary portions is then removed from the structure of FIG. 12D by the so-called lift-off method. Finally, for complete crystallization of the remaining portions of the aluminum oxide layer 54, the structure is heated to a temperature of 1000° C. in vacuum. FIG. 12E shows the thus-fabricated storage target, in which the collector electrode 17*a'* is received in the depression 50*a* in the substrate 16*a*. Care should be taken so as not to increase the impurity concentration of the substrate in forming the aluminum oxide layer 54 thereon as above.

Described hereinbelow is a mode of operation of the scan converter tube shown in FIG. 5, which is of the electrostatic deflection, electrostatic focusing type and in which is incorporated the storage target 15 of this invention. Because of its extremely high writing speed, the storage target of the invention may be incorporated advantageously in the scan converter tube of the electrostatic deflection type, rather than in that of the electromagnetic deflection type (deflection band limited to 1 MHz).

According to an example of operating mode, the cathode 21 of the scan converter tube is set at −900 volts; the control grid 22 at 0 to 75 volts (with respect to the cathode); the accelerating grid 23 at ground potential; the focusing electrode 24 at −800 volts; the astigmatism electrode 25 at ground potential; the collimation electrode 28 at ground potential; and the field mesh 29 at 1400 volts. In the case where monocrystalline aluminum oxide is employed for the target substrate 16, the collector electrode 17 is set at 1500 volts for writing, 10 volts for reading, and 15 volts for erasing.

In the scan converter tube, the field between storage target 15 and field mesh 29 has parallel "contour lines" of potential, so that the collector electrode 17 can be set at a potential which will result in the maximum secondary emission ratio of the storage substrate 16, without causing reduction of the deflection zone. Operation at maximum writing speed is thus assured. The scan converter tube differs in this respect from the direct-view storage tube. The electron beam may go out of focus as the potential of the collector electrode 17 is varied, but can be brought back into focus through adjustment of the focusing potential.

The doubling of the potentials of all the electrodes but the collector electrode 17 results in a decrease in the electron beam diameter, in an increase in the electron beam intensity, and in the consequent increase in writing speed. In this case, too, the collector electrode 17 can be set at a potential which will result in the maximum secondary emission ratio, to realize a high writing speed of 500 MHz (5000 cm/μs) or more. The storage substrate 16 according to the invention is not to burn easily even during operation in this high speed mode because of the use of the monocrystalline insulator material. It is also noteworthy that writing operation can be effected at optimum writing potential. Although the reduction of the deflection zone inevitably occurs as in the case of the direct-view storage tube, the corresponding image contraction on a monitor screen can be avoided by resorting to the zooming technique.

With the use of the storage target according to this invention, the writing speed can be further increased by making the electron beam acceleration energy greater than that of the maximum ($\delta-1$) value. Supposedly, this is because of the increase of electrons in the monocrystalline storage substrate due to the hole-electron couples generated therein.

It is clear from the foregoing that the use of the storage target of the invention in scan converter tubes results in very substantial improvements in the problems of writing speed, burning of the storage substrate, and reading time. Particularly, with the use of the storage substrate of monocrystalline aluminum oxide, with the C axis oriented normal to the substrate face, the writing speed can be made at least 10 times as high as that of the prior art. Because of such high writing speed, the scan converter tube incorporating the storage target of the invention, when used as a frame memory, permits efficient writing operation in the high-resolution mode.

The scan converter tube incorporating the storage target of the invention also finds use as the storage or memory section of a storage oscilloscope. The direct-view storage tube heretofore employed for this application has such disadvantages as low writing speed (10 MHz or 135 cm/μs), the easy burning of the storage mesh, and expensiveness. By use of the scan converter tube incorporating the storage target of the invention, the writing speed of the storage oscilloscope can be increased to 200 MHz, or 2000 cm/μs, or more. The maintenance of the storage oscilloscope will also be easy because the problem of burning is overcome by the storage target of this invention Furthermore, by virture of its high writing speed, the scan converter tube incorporating the storage target of the invention permits writing of input signals of the order of tens of megahertz at such a high level that the signal level at the time of subsequent reading is also high. Thus permitting digital processing of information, the scan converter tube finds use as a kind of high speed analog-to-digital converter.

While the present invention has been shown and described in terms of its specific embodiments, it will be understood that these embodiments are by way of example only and are not intended to impose limitations upon the invention, since numerous modifications thereof will readily occur to those skilled in the art. For example, a backward electrode may be provided to the storage substrate of the target, thereby to adjust the potential of the substrate. Also, this substrate may be supported on another suitable substrate. These and other modifications and changes within the usual knowledge of the specialists are intended in the foregoing disclosure. It is therefore appropriate that the invention be construed broadly and in a manner consistent with the fair meaning or proper scope of the following claims.

What is claimed is:

1. A scan converter tube, comprising an evacuated envelope, electron beam generation means, electron beam deflection means and a storage target, said storage target comprising a storage substrate fabricated from a single crystal of aluminum oxide having a purity of more than 99.9% and a collector electrode on one face of said storage substrate, the collector electrode being in the form of a metal film having a plurality of regularly patterned openings formed therein with a pitch of about 10 to 50 microns, and the electrode density of the storage target being in the range of from about 0.1 to 0.4.

* * * * *